US005855751A

United States Patent [19]

Rangarajan et al.

[11] Patent Number: 5,855,751

[45] Date of Patent: Jan. 5, 1999

[54] CATHODE USEFUL FOR THE ELECTROLYSIS OF AQUEOUS ALKALI METAL HALIDE SOLUTION

[75] Inventors: Surukkai Krishnamachari Rangarajan; Kailathuvalaappil Inniri Vasu; Sarangapani Krishnamurthy; Perumal Subbiah; Krishnaswamy Asokan; Kandasamy Subramanian; Vaithilingam Arumugam, all of Karaikudi, India

[73] Assignee: Council of Scientific and Industrial Research, New Delhi, India

[21] Appl. No.: 10,071

[22] Filed: Jan. 21, 1998

Related U.S. Application Data

[63] Continuation of Ser. No. 452,528, May 30, 1995, abandoned.

[51] Int. Cl.[6] ..... C25B 11/00

[52] U.S. Cl. ..... 204/290 R

[58] Field of Search ..... 204/290 R

[56] References Cited

U.S. PATENT DOCUMENTS

| | | | |
|---|---|---|---|
| 4,221,643 | 9/1980 | Miles et al. | 204/290 R |
| 4,465,580 | 8/1984 | Kasuya | 204/290 R |
| 4,970,094 | 11/1990 | Byrd | 204/290 R |
| 5,164,062 | 11/1992 | Byrd et al. | 204/290 R |
| 5,667,649 | 9/1997 | Bushman | 204/290 R |

FOREIGN PATENT DOCUMENTS

WO8603790 7/1986 European Pat. Off. .

*Primary Examiner*—Bruce F. Bell
*Attorney, Agent, or Firm*—Ladas & Parry

[57] ABSTRACT

Cathode overvoltage losses are a frequent problem in electrolysis of aqueous solutions. The present invention provides a cathode having a three component coating. The first component consists of at least one non-precious transition metal; the second consists of a precious metal or its oxide and the third consists of gold, platinum or both or their oxides.

12 Claims, 2 Drawing Sheets

CATHODE USEFUL FOR THE ELECTROLYSIS OF AQUEOUS ALKALI METAL HALIDE SOLUTION

This is a continuation of copending application Ser. No. 08/452,528 filed on May 30, 1995, now abandoned claims the benefit thereof and incorporates the same by reference.

FIELD OF THE INVENTION

This invention relates to a cathode useful for the electrolysis of aqueous alkali metal halide solutions. The invention is particularly suitable for use in systems evolving hydrogen. For example, the cathode of the process of the invention is useful in the electrolysis of aqueous alkali metal halide solutions for the production of caustic soda and chlorine, and in water electrolysis.

BACKGROUND OF THE INVENTION

Mild steel, nickel or its alloys are used as cathodes in hydrogen evolving systems. Cathode overvoltage losses are quite substantial in electrolysis of aqueous solutions. For example, hydrogen overvoltage in a non-mercury chlor-alkali cell employing mild steel cathode is of the order of 350–450 millivolts at a current density of 250 $mA.cm^{-2}$ at 80°–90° C.

One form of such non-mercury type chlor-alkali cell which is currently in use is diaphragm cell in which anode and cathode compartments are separated by a diaphragm through which the electrolyte percolates from anode compartment to the cathode compartment and caustic soda is formed at the cathode. Another form of non-mercury type chlor-alkali cell is ion-exchange membrane cell where the asbestos diaphragm is replaced with ion-exchange membrane which allows only cations to pass through so as to produce high purity, higher concentration of caustic soda in the cathode compartment. In these type of chlor-alkali cells, generally steel cathodes are used, which have high overvoltage. Due to frequent increases in the cost of electrical energy, more attention has been paid to the development of a suitable catalytic cathode which will have minimum overvoltage and long term stability. Any reduction in this cathodic overvoltage will result in a substantial power saving. Many attempts have been made to reduce the overvoltage of hydrogen evolving cathodes. One such improvement is the development of electrodes made up of steel and like coated with various materials such as nickel, nickel-iron, nickel-zinc over them by electroplating. U.S. Pat. Nos. 4,033,837 and 4,105,531 disclose a method for the electroplating of Ni—Mo—V alloy over a conductive substrate such as steel. This material had somewhat lower overvoltage than uncoated steel, but suffered from corrosion and degradation problems.

Another attempt to produce a catalytic cathode for hydrogen evolution in alkaline solutions is described in U.S. Pat. No. 3,962,844. This process involves the deposition of amorphous borides of nickel, cobalt or iron. These cathodes can only be used at temperatures as low as about 20° C. which is well below the general industrial operating temperatures which are commonly in the range of 80°–90° C. It appears that degradation of the material would take place at higher temperatures. So these cathodes have not been accepted for commercial production.

Another attempt to prepare a catalytic cathode is the development of "Raney Nickel". The process for forming a Raney Nickel catalyst over a metallic substrate such as steel or nickel is described in U.S. Pat. No. 4,116,804. The process involves plating and flame spraying of layers of nickel and aluminium respectively on the substrate followed by heating at a higher temperature to cause interdiffusion of the metals. The interdiffused aluminium is then leached out to give high surface area "Raney Nickel". Raney Nickel cathodes lack mechanical stability and are pyrophoric in nature and delamination of coating from the substrate occurs. It was found that Raney Nickel catalyst is oxidised to nickel hydroxide and becomes deactivated by the reverse current which flows during short circuit and cell shut downs. This increases the overvoltage of the cathode. Thus they have not been widely accepted for industrial use.

Japanese patent 80 12,687 describes a Raney nickel type cathode comprising of a precious metal. Such type of cathodes could not withstand current reversals, the occurence of which can not be avoided in industrial practice.

Japanese patent 80 50,478 teaches a method for the preparation of a cobalt composite coating containing non-ionic and cationic polymers. As the coating consists of one component only, these electrodes were not industrially successful.

Japanese patents 80 131,189 and 81 41,395 disclose a one component system containing catalyst alone and a two component system containing catalyst and stabiliser respectively. Both these cathodes cannot maintain constant cathodic potential due to the absorption of hydrogen on the electrode surface. European patents EP 129,088 and EP 129,734 disclose cathodes which comprise a two component system. In the absence of a third component, which is hydrogen, overvoltage reducing metal/oxide especially gold or platinum, reduction in hydrogen overvoltage is not remarkable; they also lack long term stability.

A catalytic cathode material is disclosed in European patent (EP. 240,413) which comprises the deposition of one or more precious metal or precious metal oxide and one or more metal layer (eg. Ni or Ni—P alloy) over a conducting metallic substrate. In the course of operation as a cathode material in NaOH electrolysis, the nickel in the electrode slowly absorbs hydrogen, getting reduced to nickel hydride which reduces the activity of the coating. So this electrode also suffers from long term instability. Another attempt to prepare a catalytic cathode for hydrogen evolution reaction is the preparation of Platinum-Ruthenium alloy which is described in U.K. Patent No. 2,074,190. This process comprises contacting the electrically conductive matrix (Nickel, Copper and alloys of Nickel and/or Copper including alloying metals such as Iron, Cobalt and/or Chromium) with an acidic aqueous solution of a platinum salt and a ruthenium salt, such that some of the metal of the matrix exchanges with platinum and ruthenium in the solution thereby causing deposition of platinum and ruthenium onto the matrix. Contacting the matrix with the solution is effected by dipping or spraying. The displacement deposition is spontaneous and is due to the matrix having an electrode potential above that of platinum and ruthenium. No reducing agent is present in the solution used for deposition.

By this process it is very difficult to build deposits thicker than 0.5 microns. Even if the deposit thickness is built up by some other technique, the resultant cathode will be uneconomically costlier, as the deposit contains only precious metals. Though cathodes prepared as per the above said patent exhibit low hydrogen overvoltage they lack long term stability; the most probable reason for this characteristic may be the thin electrocatalytic deposit loosely bound to the matrix. U.S. Pat. No. 5,035,789 discloses yet another method for the preparation of catalytic cathodes having a coating consisting of a two component system made of a precious metal and non-precious transition metal. The coating in this case is obtained by electroless deposition. Though these electrodes exhibit low hydrogen overvoltage they do not have long term stability, as the electrocatalyst is loosely bound to the substrate. As an improvement over this, U.S. Pat. No. 5,066,380 suggests a thermal treatment for the electrodes wherein the electrocatalysts are deposited by non-electrolytic reduction. Here the high temperature treatment given to the electrodes induces thermal stress at the interface between the coating and the substrate as their thermal expansion coefficients are different and these electrodes also do not have a long active life.

The object of the present invention is to provide a cathode useful for the electrolysis of aqueous alkali metal halide solutions overcoming the disadvantages of the prior art cathodes used in systems evolving hydrogen. The invention also provides a process for the preparation of catalytic cathode.

We have observed that if the substrate is given a coating consisting of at least an oxide of a non precious transition metal for example Nickel oxide one or more metal/oxide selected from Ru, Rh, Ir, Pd and Os with metal/oxide of Gold or Platinum or both, then the resulting cathode has high catalytic activity and exhibits low hydrogen overvoltage.

DETAILED DESCRIPTION OF THE INVENTION

Figure 1:
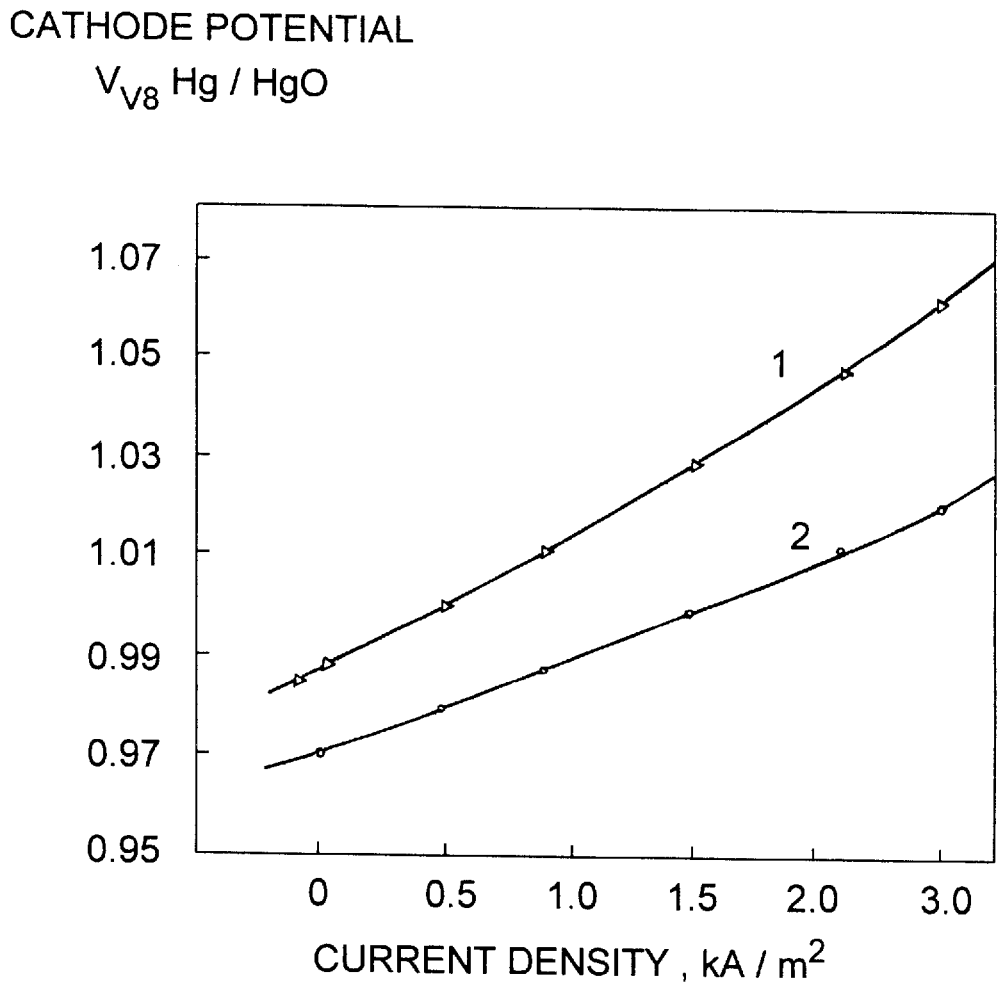
FIG. 1 illustrates the cathode potentials measured relative to standard Hg/HgO reference electrode.

Accordingly, the present invention produces a cathode useful for the electrolysis of aqueous alkali metal halide solutions which comprises a conducting substrate material having coatings thereof of, at least a three component system, the first component consisting of at least one non-precious transition metal oxide, the second component consisting of at least one precious metal or its oxide and the third component consisting of gold or platinum or their alloys or their oxides. According to a preferred embodiment of the invention the cathode comprises a corrosion resistant conducting substrate such as nickel or an alloy containing C (in the range of 0.03–0.2 wt %), Ni (in the range of 9–13 wt %), Cr (in the range of 17–23 wt %), Mo (in the range of 0–2.5 wt %) and Fe (in the range 74.93–61.3 wt %) or titanium with at least an oxide of a non precious transition metal or its oxide, metal/oxide selected from Ru, Rh, Ir, Pd, Os, and with a metal or its oxide of gold or platinum or both.

The non-precious transition metal may be chosen from titanium, iron, cobalt, nickel, vanadium and chromium. For the second component the metals may be selected from Ru, Rh, Ir, Pd and Os. The third component may be selected from Gold and/or Platinum. The ratio of the non-precious transition metal oxide to metal/oxide of Ru,Rh,Ir,Pd,Os may be 20:80 to 80:20, and the ratio of non-precious metal oxide to Gold and/or Platinum metal/oxide can be 95:5 to 5:95. All ratios are as metal by weight. The total loading of the three components may be in the range of 0.5 to 5.0 $mgm.cm^{-2}$. The coating can be imparted by thermal decomposition, flame spray or plasma spray technique.

Although a simple composition of transition metal oxide alone might be considered sufficient as a corrosion resistant, electrochemically active coating for catalytic cathodes in view of their good conductivity and catalytic activity; they tend to undergo gradual reduction. This reduced form readily absorbs hydrogen and develops high hydrogen overvoltage during electrolysis. For this reason, in the present invention the catalytic cathode contains three components, an electro- catalyst, a stabiliser which prevents the reduction of the catalyst, while the third component improves the catalytic activity of the electrode and to reduces the absorption of hydrogen on the resulting electrode surface. The catalytic coating has sufficient corrosion resistance in alkaline medium, exhibits low hydrogen overvoltage, has long term stability and it withstands current reversals.

The formation of the catalytic coatings can be done by the pyrolytic deposition method which comprises the steps of applying a solution of the salts of the selected metals in organic solvents like butanol, ethanol, propanol and isopropanol over the sand blasted, pretreated substrate and then heating the coated substrate at temperatures ranging from 300°–600° C. thereby forming the catalytic coating over the substrate. Alternatively the catalytic coating can be formed over the substrate by flame or plasma spraying of the mixed metals/metal oxides.

The substance which forms the active coating of the cathode is a mixture of nickel oxide or cobalt oxide or any other oxide of a non-precious transition metal with metal/oxide of precious metals such as Ru, Rh, Ir, Pd and Os and a metal/oxide of Gold or Platinum or both.

It was found that the long term stability of the coating can be enhanced by increasing the loading of the third component, for example Gold or Platinum or both as metals or oxides. Adhesion of the coating can be improved by proper roughening of the substrate prior to the application of the electrocatalytic layer. Such roughening may be carried out by techniques such as grit, sandblasting or etching.

The cathode of the present invention is particularly useful in chlor-alkali or water electrolysis cells where a cathode is required to be in contact with aqueous alkali metal hydroxide. Cathodes made using Nickel or Nickel alloy substrate are suitable for the production of halates of Sodium and Potassium.

In non-mercury type chlor-alkali cells, a reduction in cathode potential of about 200–250 mV can be achieved at a current density range of 250–300 $mA.cm^{-2}$ in 30–33 wt % NaOH solution at a temperature of 80°–85° C. Further these electrodes have long term stability. They maintain constant potential in a laboratory scale non mercury chlor-alkali cell for over 20000 hours. The following typical examples are given to illustrate the invention and should not be construed to limit its scope.

EXAMPLE 1

A sheet of an alloy containing C (in the range of 0.03–0.2 wt %), Ni (in the range of 9–13 wt %), Cr (in the range of 17–23 wt %), Mo (in the range of 0–2.5 wt %) and Fe (in the range of 74.93–61.3 wt %) of size 17 cm×1 cm×1 mm is sand blasted, degreased in trichloro ethylene and etched in 1:1 hydrochloric acid at 70° C. for 5 minutes. It is then washed with water and then dried. It is painted with a solution containing 6.5 mg of platinum chloride, 120 mg of Nickel chloride and 20 mg of Ruthenium chloride in 4.5 ml of iso-propyl alcohol. It is then dried and baked at a temperature of 400° C. for 10 minutes. Brushing and baking is repeated till the solution is exhausted. Final baking is done at a temperature of 420° C. for one hour. This electrode is tested for hydrogen overvoltage using Hg/HgO reference electrode in 30 Wt % NaOH at 80° C. at a current density of 300 mA.cm$^{-2}$. This electrode registered a cathode overpotential of 70–90 mV. Then the current is switched off for 1 hour and the temperature of the electrolyte is brought down to room temperature. After the temperature has come down to room temperature, it is heated to 80° C. and again the hydrogen overvoltage was measured. There is no change in the overvoltage even after 10 such current reversals.

EXAMPLE 2

A sheet of an alloy containing C (in the range of 0.03–0.2 wt %), Ni (in the range of 9–13 wt %), Cr (in the range of 17–23 wt %), Mo (in the range of 0–2.5 wt %) and Fe (in the range of 74.93–61.3 wt %) of size 17 cm×1 m×1 mm is sand blasted, degreased in trichloro ethylene and etched in 1:1 hydrochloric acid at 70° C. for 5 minutes. It is then washed with water and then dried. It is painted with a solution containing 100 mg of Cobalt chloride, 50 mg of ruthenium chloride, 33 mg of platinum chloride and 0.02 ml of titanium tetra chloride dissolved in 5.5 ml of isopropyl alcohol. It is then dried and baked at a temperature of 400° C. for 10 minutes. Brushing and baking is repeated till the solution is exhausted. Final baking is done at a temperature of 420° C. for one hour. This electrode is tested for hydrogen overvoltage using Hg/HgO reference electrode in 30 Wt % NaOH at 80° C. at current density of 300 mA.cm $^{-2}$. This electrode registered a cathode overpotential of 160–180 mV. Then the current is switched off for 1 hour and the temperature of the electrolyte is brought down to room temperature. After the temperature has come down to room temperature, it is heated to 80° C. and again the hydrogen overvoltage was measured. When this electrode was subjected to 10 such current reversals, it was found that the overvoltage was 170–200 mV only.

EXAMPLE 3

A titanium sheet of size 17 cm×1 cm×1 mm is sand blasted, degreased in trichloro ethylene and etched in 1:1 hydrochloric acid at 70° C. for 5 minutes. It is then washed with water and then dried. It is painted with a solution containing 90 mg ferric chloride, 60 mg palladium chloride, 13 mg of platinum chloride and 0.04 ml of titanium tetra chloride in 5.5 ml of isopropyl alcohol. It is then dried and baked at a temperature of 400° C. for 10 minutes. Brushing and baking is repeated till all the solution is exhausted. Final baking is done at a temperature of 420° C. for one hour. This electrode is tested for hydrogen overvoltage using Hg/HgO reference electrode in 30 Wt % NaOH at 80° C. at current density of 300 mA.cm$^{-2}$. This electrode registered a cathode overpotential of 200–250 mV. Then the current is switched off for 1 hour and the temperature of the electrolyte is brought down to room temperature. After the temperature has come down to room temperature. it is heated to 80° C. and again the hydrogen overvoltage was measured. This cathode gave a overvoltage of 200–250 mV less than conventional cathodes in a laboratory scale chlorate cell. When this electrode was subjected to current reversals, there is no change in hydrogen overvoltage after 10 such current reversals.

EXAMPLE 4

A titanium sheet of size 17 cm×1 cm×1 mm is sand blasted, a degreased in trichloro ethylene and etched in 1:1 hydrochloric acid at 70° C. for 5 minutes. It is then washed with water and then dried, It is painted with a solution containing 47 mg of iridium chloride, 120 mg of cobalt chloride and 50 mg of ruthenium chloride dissolved in 4.5 ml of isopropyl alcohol. It is then dried and baked at a temperature of 400° C. for 10 minutes. Brushing and baking is repeated till the solution is exhausted. Final baking is done at a temperature of 420° C. for one hour. This electrode registered a hydrogen overvoltage 170–200 mV less than conventional cathode in a typical laboratory scale hypochlorite cell. The cathode is subjected to ten current reversals and there is no change in the hydrogen overvoltage after 10 current reversals.

EXAMPLE 5

A titanium sheet of size 17 cm×1 cm×1 mm is sand blasted, degreased in trichloro ethylene and etched in 1:1 hydrochloric acid at 70° C. for 5 minutes. It is then washed with water and then dried. The painting solution is prepared using the following chemicals.

| | |
|---|---|
| Platinum chloride | 5 mg |
| Ruthenium chloride | 33 mg |
| Cobalt chloride | 54 mg |
| Titanium cetra chloride | 0.025 ml and |
| Iso-propyl alcohol | 1.5 ml |

This coating is done as in example 1 and hydrogen overvoltage of this electrode is measured in a laboratory scale alkaline water electrolyser. Cathodic overvoltage was 200–240 mV less than the conventional cathodes. There is no change in the hydrogen overvoltage after ten current reversals.

EXAMPLE 6

Sand blasted and degreased nickel sheet of size 17 cm×1 cm×3 mm is etched in 2N nitric acid at 50° C. for 3 minutes. It is then washed with water, dried and coated with the painting solution as in example 3. The hydrogen overvoltage of this cathode is 70–80 mV with respect to Hg/HgO reference electrode under identical conditions as in example 1 and it was found that there is no appreciable change in the overvoltage for hydrogen evolution in 30 wt % NaOH at the experimental conditions as in example 1.

EXAMPLE 7

A sheet of an alloy containing C (in the range of 0.03–0.2 wt %), Ni (in the range of 9–13 wt %), Cr (in the range of 17–23 wt %), Mo (in the range of 0–2.5 wt %) and Fe (in the range of 74.93–61.3 wt %) of size 17 cm×1 cm×1 mm is sand blasted, degreased in trichloro ethylene and etched in 1:1 hydrochloric acid at 70° C. for 5 minutes. It is then washed with water and then dried. It is then coated with 70:30 by weight of nickle aluminium powder by plasma spray technique using "Plasma Dyne" equipment. The thickness of the coating corresponds to 20 microns. Then the aluminium is leached out using 30 wt % NaOH at 80° C. for 4 hours. Then the electrode is coated with the painting solution as in example 1. The hydrogen overvoltage of this electrode is found to be 70–80 mV at the experimental conditions mentioned in example 1 and there is no appreciable change in the hydrogen overvoltage after ten current reversals.

EXAMPLE 8

A sheet of an alloy containing C (in the range of 0.03–0.2 wt %), Ni (in the range of 9–13 wt %), Cr (in the range of 17–23 wt %), Mo (in the range of 0–2.5 wt %) and Fe (in the range of 74.93–61.3 wt %) of size 17 cm×1 cm×1 mm is sand blasted, degreased in trichloro ethylene and etched in 1:1 hydrochloric acid at 70° C. for 5 minutes. It is then washed with water and then dried. It is then coated with 50:50 by weight of nickle aluminium powder by plasma spray technique using "Plasma Dyne" equipment. The thickness of the coating corresponds to 20 microns. Then the aluminium is leached out using 30 wt % NaOH at 80° C. for 4 hours. Then the electrode is coated with the painting solution as in example 1. The hydrogen overvoltage of this electrode is found to be 100–110 mV at the experimental conditions mentioned in example 1 and there is no appreciable change in the hydrogen overvoltage after ten current reversals.

EXAMPLE 9

A sheet of an alloy containing C (in the range of 0.03-0.2 wt %), Ni (in the range of 9–13 wt %), Cr (in the range of 17–23 wt %), Mo (in the range of 0–2.5 wt %) and Fe (in the range of 74.93–61.3 wt %) of size 17 cm×1 cm×1 mm is sand blasted, degreased in trichloro ethylene and etched in 1:1 hydrochloric acid at 70° C. for 5 minutes. It is then washed with water and then dried. It is coated with a catalytic coating by taking 75 parts by weight of nickel, 20 parts by weight of palladium and 5 parts by weight of iridium as metal content, by plasma spray technique. The coating thickness corresponds to 5 microns, and it is heated at 300°–400° C. for 1 hour in the presence of air. This electrode gave a hydrogen overvoltage of 60–70 mV under identical conditions mentioned in example 1 and there is no appreciable change in the hydrogen overvoltage after ten current reversals.

Comparative data substantiating the advantages of the cathode of the present invention over and above that of the prior art processes is given in Table 1.

Figure 2:
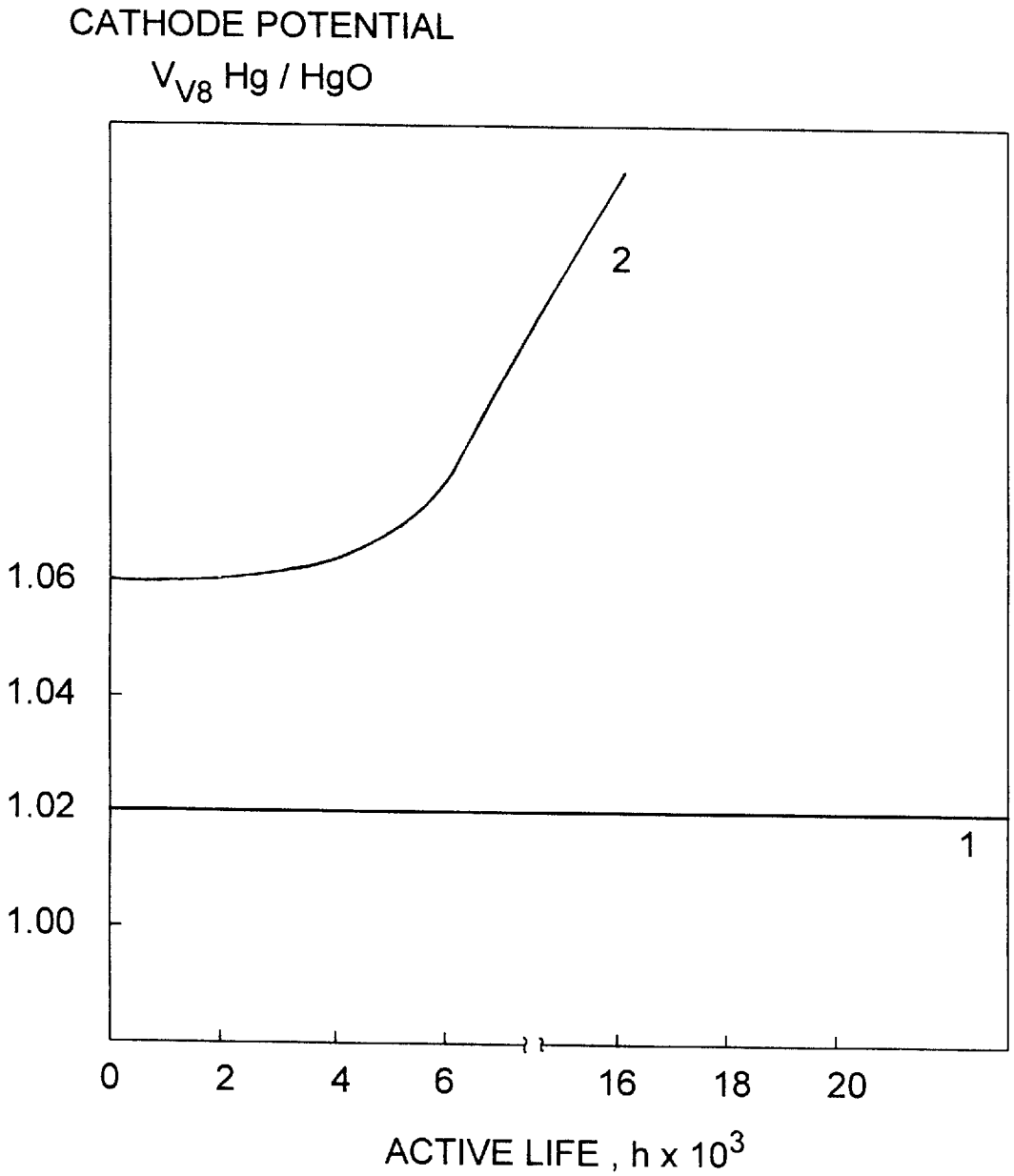
FIG. 2 illustrates the active life of cathodes.

In the drawings, FIG. 1 shows curves illustrating the cathode potentials measured relative to standard Hg/HgO reference electrode ln 30 wt % NaOH solution at 80° C. at different current densities. Curve(1) is for a cathode based on a two component system consisting of Ruthenium and Nickel alone. Curve(2) is for the cathode, prepared as per the present invention. FIG. 2 shows curves illustrating the active life of the cathodes in 30 wt % NaOH solution at a current density of 3 kA.m$^{-2}$ at 80° C. Curve(1) is for the cathode prepared as per the present invention and Curve(2) is for a cathode based on a two component system consisting of Ruthenium and Nickel alone.

TABLE 1

| | Cathode Material | Cathode overvoltage*, mV | Remarks |
|---|---|---|---|
| 1. | Ni—Fe—Cr alloy steel | 400 | High overvoltage |
| 2. | Nickel | 400 | High overvoltage |
| 3. | Ni—Mo—V alloy Electroplated cathode (U.S. Pat. Nos. 4033837 and 4105331) | 100—150 | Lacks long term stability |
| 4. | Transition metal boride deposited cathode. (U.S. Pat. No. 3926844) | 100–200 | Unstable at industrial operating temperatures |
| 5. | Raney Nickel (U.S. Pat. No. 4116844 and Japanese patent 8012887) | 80–200 | Lacks long term stability |
| 6. | Cobalt composite (Japanese patent 8050478) | 100–200 | Lacks long term stability |
| 7. | Platinum-Ruthenium alloy deposited cathode (UK. patent 2074190 and U.S. Pat. Nos. 5035789 and 5066380) | 80–120 | Lacks long term stability |
| 8. | Catalytic cathodes of the present invention | 70–80 | Cathode potential remains constant even after 20,000 hours. |

*in 30 wt % NaOH solution, at a current density of 300 mA cm$^{-2}$ and temperature of 80° C.

We claim:

1. A cathode for the electrolysis of aqueous alkali chloride solution which comprises a conducting substrate material consisting essentially of carbon in an amount in the range of 0.03 to 0.2% by wt.; nickel in an amount in the range of 9 to 13% by wt.; chromium in an amount in the range of 17 to 23% by wt.; molybdenum in an amount in the range of 0.0 to 2.5% by wt. and iron in an amount in the range of 74.93 to 61.3% by wt., said substrate having a coating thereon consisting of a three component system, the first component consisting of nickel oxide, a second component consisting of at least one precious metal or its oxide selected from the group consisting of rhodium, iridium, palladium and osmium, and a third component consisting of gold, platinum, oxides of gold or platinum, or a mixture thereof.

2. The cathode according to claim 1, wherein the coating is formed by a thermal process.

3. A cathode as claimed in claim 1, wherein the nickel oxide and precious metal or its oxide are in a ratio of from 20:80 to 80:20.

4. A cathode as claimed in claim 1, wherein the nickel oxide and gold are in a ratio in the range of from 95:5 to 5:95.

5. A cathode as claimed in claim 1, wherein the nickel oxide and platinum are in a ratio in the range of from 95:5 to 5:95.

6. A cathode as claimed in claim 1, wherein the ratio of the nickel oxide to the total amount of gold and platinum is in the range of 95:5 to 5:95.

7. A cathode as claimed in claim 1, wherein the total amount of the three components coated on the conducting substrate material ranges from 0.5 to 5.0 mgm.cm$^{-2}$.

8. The cathode of claim 1, having an over voltage of 60–90 mV.

9. The cathode of claim 1, having an over voltage of 60–70 mV.

10. The cathode of claim 1, having an over voltage of 70–90 mV.

11. The cathode of claim 1, having an over voltage of 70–80 mV.

12. The cathode according to claim 1, wherein the thermal process is thermal decomposition, flame spray or plasma spray technique.

* * * * *